US006581241B2

(12) United States Patent
Shaver et al.

(10) Patent No.: US 6,581,241 B2
(45) Date of Patent: Jun. 24, 2003

(54) VACUUM CLEANER HAVING AIRFLOW RECIRCULATION PATH FOR COOLING BEATER BRUSH MOTOR

(75) Inventors: David M. Shaver, Brockville (CA); Oleksiy P. Sergyeyenko, Brockville (CA); Murray D. Hunter, Kingston (CA)

(73) Assignee: Black & Decker Inc., Newark, DE (US)

( * ) Notice: Subject to any disclaimer, the term of this patent is extended or adjusted under 35 U.S.C. 154(b) by 93 days.

(21) Appl. No.: 09/886,961

(22) Filed: Jun. 21, 2001

(65) Prior Publication Data

US 2002/0194700 A1 Dec. 26, 2002

(51) Int. Cl.[7] ..... A47L 9/00
(52) U.S. Cl. ..... 15/413
(58) Field of Search ..... 15/344, 345, 346, 15/352, 377, 412, 413

(56) References Cited

U.S. PATENT DOCUMENTS

| | | | | |
|---|---|---|---|---|
| 2,291,689 | A | 8/1942 | Carlson | |
| 2,314,334 | A | 3/1943 | Frantz | |
| 3,383,765 | A | 5/1968 | Meltzer | |
| 3,454,978 | A | 7/1969 | Kuwahara | |
| 3,704,482 | A | * 12/1972 | Brannon | 15/348 |
| 3,854,164 | A | 12/1974 | Schmitz | |
| 3,857,076 | A | 12/1974 | Hetland | |
| 4,870,714 | A | 10/1989 | Miner | |
| 4,959,885 | A | * 10/1990 | Sovis et al. | 15/335 |
| 5,092,015 | A | 3/1992 | Kosten et al. | |
| 5,105,505 | A | 4/1992 | Reed, Jr. | |
| 5,134,751 | A | 8/1992 | Reed, Jr. et al. | |
| 5,421,058 | A | 6/1995 | Zahuranec et al. | |
| 5,638,575 | A | 6/1997 | Sin | |
| 5,797,163 | A | 8/1998 | Whitaker et al. | |
| 5,799,363 | A | * 9/1998 | Inoue et al. | 15/327.3 |
| 5,829,090 | A | 11/1998 | Melito et al. | |
| 5,974,623 | A | 11/1999 | Cummins et al. | |
| 6,032,327 | A | * 3/2000 | Oka et al. | 15/346 |
| 6,308,374 | B1 | 10/2001 | Bobrosky et al. | |

FOREIGN PATENT DOCUMENTS

| | | | |
|---|---|---|---|
| DE | 3904289 | A1 | 8/1990 |
| EP | 0 430 415 | A1 | 6/1991 |
| EP | 0 970 651 | A2 | 1/2000 |
| JP | 11-42184 | * | 2/1999 |
| JP | 11-187989 | * | 7/1999 |

* cited by examiner

*Primary Examiner*—Terrence R. Till
(74) *Attorney, Agent, or Firm*—Harness, Dickey & Pierce, P.L.C.

(57) ABSTRACT

A vacuum cleaner system incorporating a closed loop airflow recirculation path for cooling a beater brush motor. A portion of clean, exhaust airflow created by a fan is diverted away from an exhaust port of the housing and directed into a flow path running alongside a portion of the housing. The airflow is used to pressurize a compartment within which a beater brush motor is disposed. A low pressure area created by the fan is used to assist in drawing the cooling exhaust airflow through the compartment, to thus form a closed loop cooling air recirculation system using only clean, filtered exhaust airflow to maintain the beater brush motor cool during use.

8 Claims, 3 Drawing Sheets

VACUUM CLEANER HAVING AIRFLOW RECIRCULATION PATH FOR COOLING BEATER BRUSH MOTOR

FIELD OF THE INVENTION

This invention relates to vacuum cleaner systems, and more particularly to a vacuum cleaner system having an electric powerhead which includes an airflow recirculation path for providing a cooling airflow over a beater brush motor.

BACKGROUND OF THE INVENTION

Vacuum cleaners typically include a main motor which has a fan attached to an output shaft thereof for creating a suction airflow through an intake port. The suction airflow travels through a filter assembly and is exhausted through an exhaust outlet on the housing. Such vacuum cleaners also typically include a beater brush assembly which is driven rotationally by a separate beater brush motor. The beater brush motor is often disposed in a forward end of the housing.

Various attempts have been made to devise means for cooling the beater brush motor with varying degrees of success. One specific arrangement is shown in U.S. Pat. No. 5,638,575, and assigned to Techtronic, Ind. The cooling arrangement disclosed in this patent relies on drawing ambient air in through an opening disposed near a compartment which houses the beater brush motor and relying on a venturi effect created by the suction airflow as it flows past an opening in the compartment. However, this arrangement appears to rely entirely on the venturi effect created by the suction airflow, with no assistance from the exhaust flow out of the main fan of the device.

It is therefore desirable to provide some form of cleaning arrangement for use with a vacuum cleaner which does not rely entirely on the venturi effect created by the main suction airflow flowing past the compartment which houses a beater brush motor.

SUMMARY OF THE INVENTION

The present invention is directed to a vacuum cleaner system having a closed loop airflow recirculation path for continuously directing a cooling airflow over a beater brush motor. In a preferred embodiment the vacuum cleaner system includes a housing having an electric motor with a fan driven by an output shaft of the motor. The suction airflow created by the fan draws in dust and dirt entrained air through an intake port of the housing and through a filter assembly. The filtered suction airflow is exhausted through an exhaust port of the housing generating exhaust airflow. However, a portion of the clean, exhaust airflow is diverted away from the exhaust port of the housing and through a secondary flow path within the housing to a compartment in which a beater brush motor is housed. This serves to pressurize the motor compartment with clean air. An outlet of the compartment is disposed adjacent to the intake port such that the main suction airflow flows past the outlet of the compartment, thus creating a venturi effect which also helps to draw the clean, cooling airflow over the beater brush motor.

The present invention thus does not rely entirely on the venturi effect created by the main suction airflow to draw in a cooling airflow into the beater brush compartment. When pressurizing the beater brush compartment with a portion of clean air produced by the fan, a significant degree of cooling is achieved for the beater brush motor.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 is a cutaway perspective view of the powerhead showing the cooling airflow path therein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
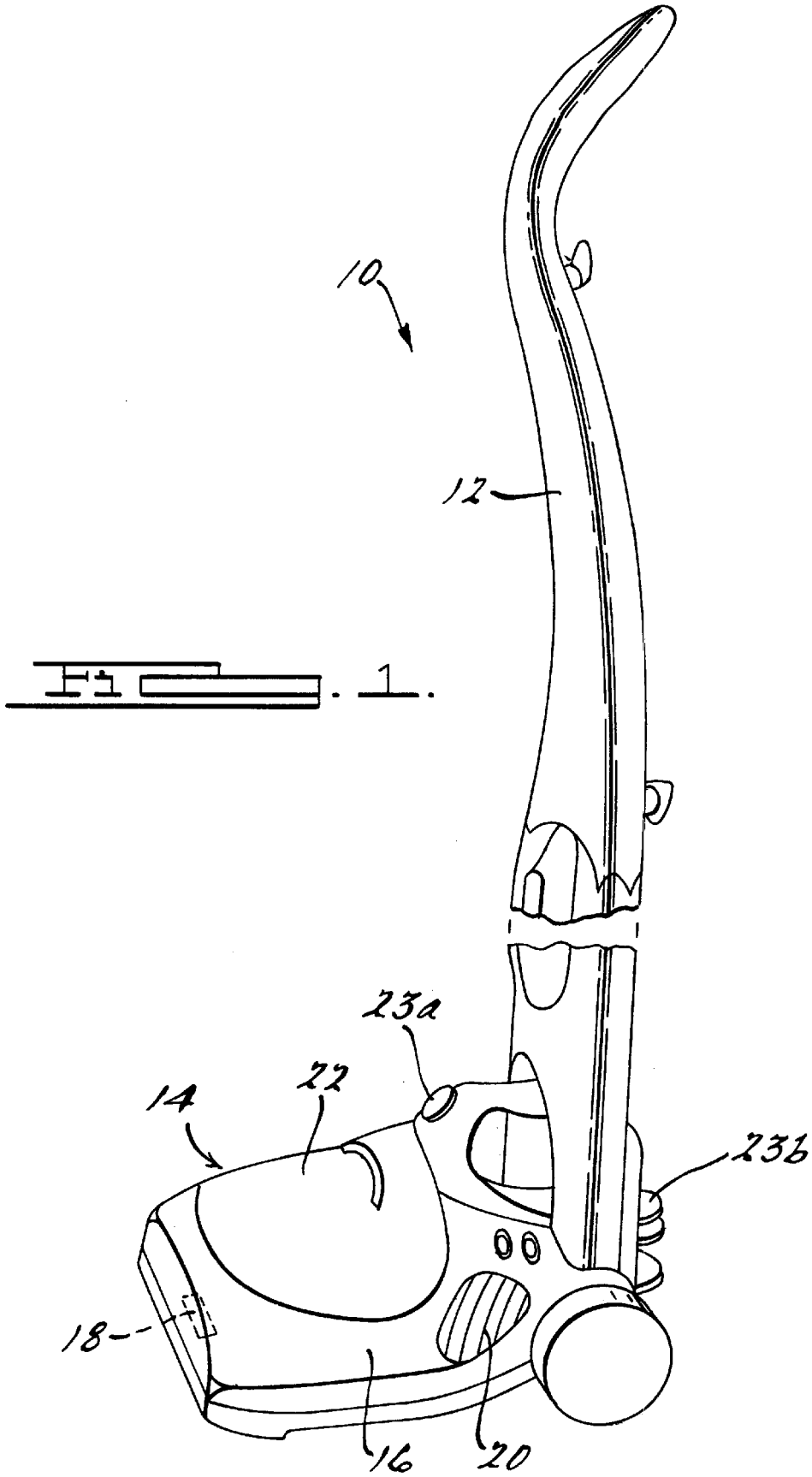
FIG. 1 is a perspective view of a vacuum cleaner system incorporating the beater brush cooling system in accordance with a preferred embodiment of the present invention.

Referring to FIG. 1, there is shown a vacuum cleaner system 10 incorporating a beater brush cooling system in accordance with the present invention. The vacuum cleaner system 10 includes an upright handle 12 which is secured to a powerhead 14. The powerhead 14 includes a housing 16 having an intake port 18 (also shown in FIG. 3) opening into a beater brush housing area and an exhaust port 20. A dirt cup 22 is carried by the housing 16 and collects dust, dirt and other debris entrained in the suction airflow drawn in through the intake 18. On/Off switches 23*a* and 23*b* allow the user to turn on and off the vacuum cleaner 10 with either a thumb or a portion of a foot.

It will be appreciated immediately that the principals of the present invention could be used with any type of vacuum cleaning device incorporating a beater brush motor or any other auxiliary motor. Thus, the present invention should not be construed as being limited to use only with an upright style vacuum cleaner system as shown in FIG. 1.

Figure 2:
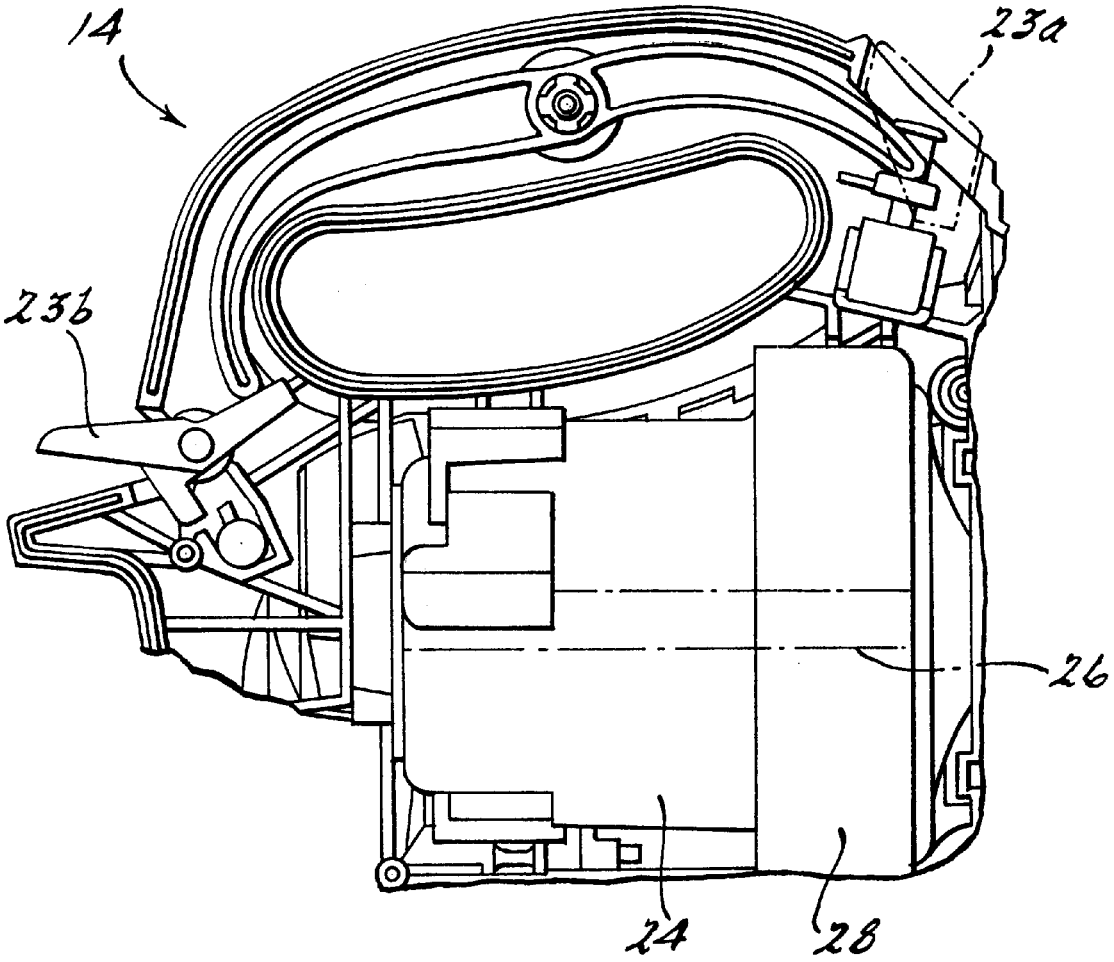
FIG. 2 is a cut away view of just the electric powerhead of the vacuum cleaner system of FIG. 1 showing in greater detail the closed loop cooling airflow path for cooling the beater brush motor.
Figure 2:
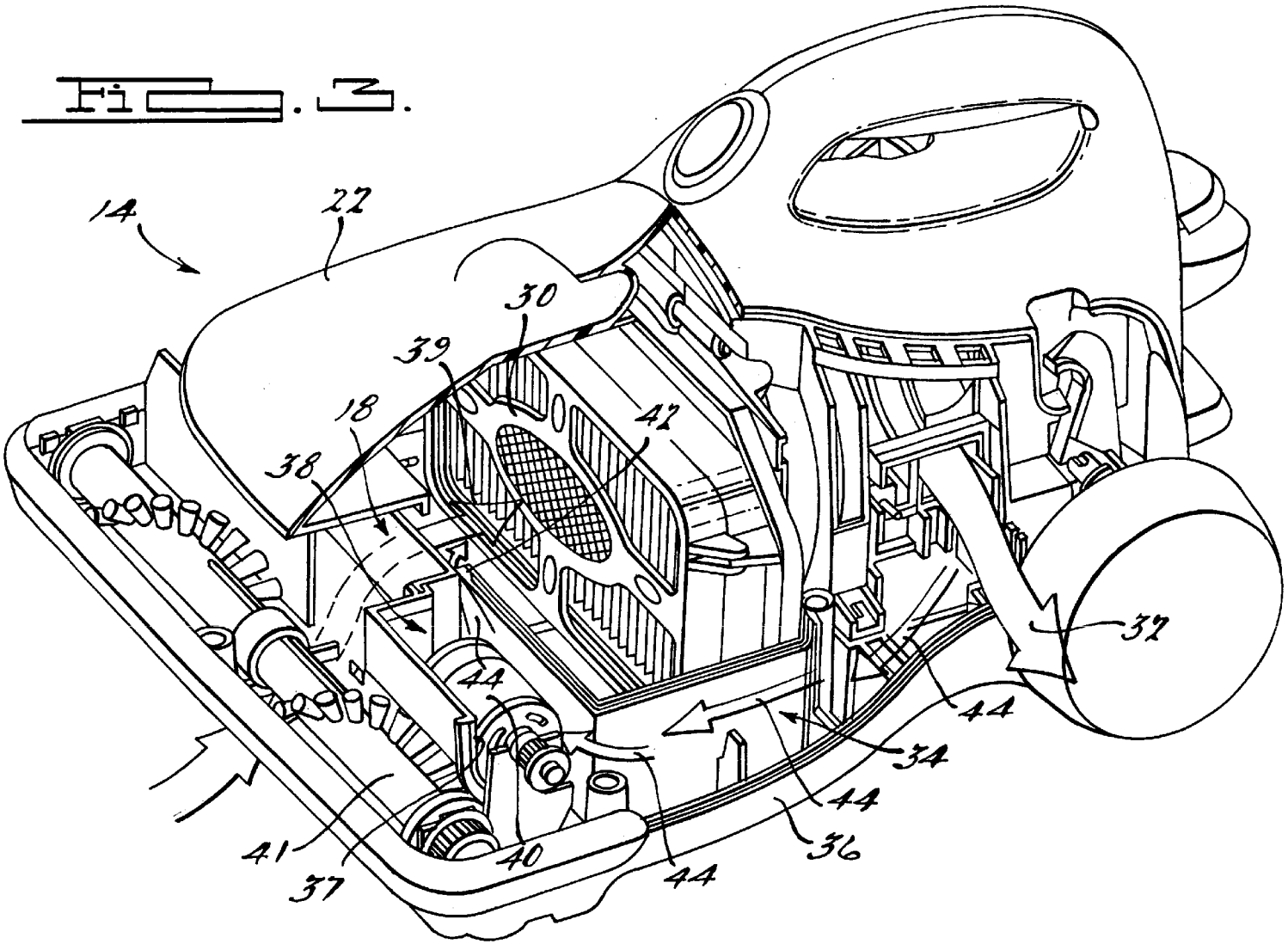

Referring now to FIG. 2, the interior construction of a portion of the powerhead 14 can be seen in greater detail. A motor 24 having an output shaft 26 drives a fan 28. The fan 28 creates a suction airflow through the intake 18 (FIG. 1) thus drawing in dust and dirt entrained air into the dirt cup 22 of the powerhead 14. These components are well known in the vacuum cleaner art and no further discussion concerning their operation is needed With reference to FIG. 3, the dirt cup 22 includes a filter assembly 30 which filters the dust and dirt entrained air and directs a clean airflow out in accordance with arrow 32 through the exhaust port 20 (not shown in FIG. 3). However, a flow path 34 is formed along a side portion 36 of the housing 16. The flow path 34 is in communication with an inlet 37 of a compartment 38 which houses a beater brush motor 40. The beater brush motor 40 drives a beater brush 41. The compartment 38 also includes an airflow outlet 42 which is disposed adjacent the path of a suction airflow 39 drawn in through the intake port 18.

During operation, a portion of the clean, exhaust airflow 32 is diverted, in accordance with direction arrows 44 to flow into the flow path 34. This portion 44 of the clean exhaust airflow 32 flows into inlet 37 of the compartment 38 thus pressurizing the compartment and cooling the beater brush motor 40. This pressurizing of the compartment 38 by a portion of the exhaust airflow 32 serves to ensure a continuous flow of clean, cooling airflow into the compartment and through the outlet 42.

It is an advantage of the present invention that the compartment 38 is pressurized with a portion 44 of the clean suction airflow 32. This is in contrast to prior developed cooling arrangements which rely solely on the venturi effect created adjacent to the beater brush motor compartment to draw in ambient air through slats or other openings in the housing over the compartment. The cooling system of the present invention thus provides a "closed loop" air recirculation path for circulating air through the flow path 34, the compartment 38 and the dirt cup 22. A further advantage is that the cooling air supplied to the compartment 38 is clean exhaust air rather than the dirt and dust entrained ambient air.

The cooling system of the present invention further does not significantly complicate the assembly or manufacture of the powerhead 14 nor significantly add to its weight, or otherwise reduce the efficiency of the suction airflow to run in through the intake port 18 of the housing 16.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A vacuum cleaner system comprising:

a housing having an intake port and an exhaust port;

a main motor having an output shaft;

a fan coupled to said output shaft for generating a suction airflow through said intake port, said suction airflow being expelled as an exhaust airflow through said exhaust port;

a beater brush motor for driving a beater brush;

a compartment formed within said housing for at least partially enclosing said beater brush motor; and a flow path in communication with said fan and said compartment, wherein a portion of said exhaust airflow is diverted into said flow path and a remainder of said exhaust flow is exhausted outwardly away from said beater brush, said portion of said exhaust airflow serving to pressurize said compartment to cool said motor.

2. The vacuum cleaner of claim 1, wherein said compartment includes an airflow inlet at one end thereof and an airflow outlet at an opposite longitudinal end thereof; and wherein said portion of said exhaust airflow that enters said compartment exits through said airflow outlet.

3. The vacuum cleaner of claim 1, wherein said flow path extends along a side portion of said housing.

4. The vacuum cleaner of claim 1, wherein a closed loop flow path is formed for said portion of said exhaust airflow to constantly circulate said portion of said exhaust airflow over said beater brush motor.

5. A vacuum cleaner system comprising:

a housing having an intake port and an exhaust port;

a main motor having an output shaft;

a fan coupled to said output shaft for generating a suction airflow through said intake port, said suction airflow being expelled as an exhaust airflow through said exhaust port;

a beater brush motor for driving a beater brush;

a compartment formed within said housing for at least partially enclosing said beater brush motor, said compartment having an airflow inlet and an airflow outlet;

a flow path in communication with said fan and said compartment, wherein a portion of said exhaust airflow is diverted away from said exhaust port into said flow path and routed into said airflow inlet of said compartment, said portion of said exhaust airflow serving to pressurize said compartment and to cool said motor; and wherein said fan creates a low pressure area adjacent said airflow outlet of said compartment to assist in drawing said portion of said exhaust airflow over said motor and through said compartment.

6. The system of claim 5, wherein said flow path extends along a side portion of said housing.

7. The system of claim 5, wherein a closed loop air recirculation path is formed within said housing for cooling said beater brush.

8. A vacuum cleaner system comprising:

a housing having an intake port and an exhaust port;

a dirt retaining cup having a filter assembly and carried by said housing;

a beater brush;

a main motor having an output shaft;

a fan coupled to said output shaft for generating a suction airflow through said intake port, said suction airflow being drawn through said dirt retaining cup and said filter assembly and expelled as an exhaust airflow through said exhaust port;

a beater brush motor for driving said beater brush;

a compartment formed within said housing for at least partially enclosing said beater brush motor, said compartment having an airflow inlet and an airflow outlet;

a flow path in communication with said fan and said compartment and extending along side said dirt cup;

a portion of said exhaust airflow is diverted away from said exhaust port into said flow path and routed into said airflow inlet of said compartment, said portion of said exhaust airflow serving to pressurize said compartment and to cool said motor;

wherein said fan creates a low pressure area adjacent said airflow outlet of said compartment to assist in drawing said portion of said exhaust airflow over said motor and through said compartment; and wherein said flow path facilitates a closed loop cooling airflow path within said housing.

* * * * *